US005625933A

United States Patent [19]

Neuberger et al.

[11] Patent Number: 5,625,933

[45] Date of Patent: May 6, 1997

[54] STORAGE CONTAINER AND DISPLAY FOR CREMATED REMAINS

[76] Inventors: Cheryl G. Neuberger, P.O. Box 7064, Vero Beach, Fla. 32961; Lindsay C. McClenny, 272 Easy St., Ft. Pierce, Fla. 34982

[21] Appl. No.: 590,167

[22] Filed: Jan. 23, 1996

Related U.S. Application Data

[63] Continuation-in-part of Ser. No. 42,592, Aug. 14, 1995, Pat. No. Des. 374,963.

[51] Int. Cl.[6] ..... A61G 17/00

[52] U.S. Cl. ..... 27/1; 27/35; 40/611

[58] Field of Search ..... 27/1, 2, 35; 40/611, 40/567, 575

[56] References Cited

U.S. PATENT DOCUMENTS

| | | | |
|---|---|---|---|
| 1,474,424 | 11/1923 | Maxey | 40/611 X |
| 3,254,773 | 6/1966 | Diem | 27/1 |
| 3,803,738 | 4/1974 | Weiss | 40/611 X |
| 4,199,848 | 4/1980 | Kohnert | 27/1 |
| 5,230,127 | 7/1993 | Zukowski | 27/1 |
| 5,287,603 | 2/1994 | Schorman | 27/1 |

*Primary Examiner*—Kien T. Nguyen
*Attorney, Agent, or Firm*—William M. Hobby, III

[57] ABSTRACT

A storage container for cremated remains has a container having a plurality of walls for receiving the cremated remains through an opening in the container. A panel insert area is formed in the container for holding a decorative panel therein. The panel insert area has a bottom flange for holding the decorative panel along the bottom edge. A decorative panel having a decorative design thereon is supported in the panel insert area for displaying the decorative design. A removable top is attached over the container opening with a plurality of fasteners and has an elongated lip formed on one side thereof extending over one side of the front panel insert area and over one edge of the decorative panel in the insert area to thereby hold the decorative panel in the insert area along the top edge. A system for storing a plurality of storage containers for cremated remains includes a plurality of horizontal frame members having a plurality of urn support brackets attached thereto with each bracket having a generally cross cross-section shape for supporting each of the urns in a predetermined position. Each urn can have a portion of an image displayed thereon so that a plurality of urn display panels can be attached to the supports to form a complete image.

14 Claims, 2 Drawing Sheets

STORAGE CONTAINER AND DISPLAY FOR CREMATED REMAINS

This application is a continuation-in-part of application Ser. No. 29/042,592, filed Aug. 14, 1995 now U.S. Pat. No. Des. 374963.

BACKGROUND OF THE INVENTION

The present invention relates to storage containers for cremated remains and to a system for attaching a plurality of the storage containers for displaying displays on each container.

There have been a variety of urns for holding cremated human and animal remains. These include a wide variety of decorative memorial urns which can be stored indoors or outdoors in repository structures in permanent side-by-side niche arrangements formed in or along the walls of a building. The decorative urns of varying shapes are placed in the niches and usually have glass covers placed over the openings of the niches for viewing purposes. Such an urn niche repository is sometimes referred to as a columbarium. Closed faced niches are also used in columbariums and these are usually covered with face plates of bronze, marble, or granite which may carry personalized memorial inscriptions pertaining to the deceased. In such closed faced niche internments, a less expensive non-decorative urn-like container may also be used. Urns containing cremated remains are also stored outdoors in closed faced niches formed in vertical standing walls and in horizontally situated internment arrays. There have also been various framed or modular structures for supporting urns but they have frequently proved unduly expensive and complex to manufacture and construct. In order to reduce cost without sacrificing the aesthetic appearance of niche repositories, it has been proposed to make the niche openings in non-decorative containers of a standardized size.

Typical prior art storage systems for holding cremated remains may be seen in the Hancovsky patent, U.S. Pat. No. 4,607,417, which has an urn-like canister for storing and transporting cremated remains made of a molded plastic material. The canister is adapted to be inserted into one of an array of openings formed in a niche plate of a type having a recessed flange surrounding each niche opening. In the See patent, U.S. Pat. No. 4,688,359, a mausoleum for cremated remains includes linear and columnar displays of arrays of transparent display vessels which can be illuminated. The Eickhof patent, U.S. Pat. No. 5,195,812, is a columbarium constructed with a framework having vertical risers and having brackets mounted thereto. Tie rods extend horizontally through the brackets to connect the risers to form niche supports for cremated remains which can have a decorative stone facing attached to the front of each shelf. The Schorman patent, U.S. Pat. No. 5,287,603, is for a storage container for human remains. The Hunter patent, U.S. Pat. No. 617,161, is a burial structure for human remains. The Diem patent, U.S. Pat. No. 3,183,574, is for an urn and a frame for supporting the urns. The combination urn and frame construction has a supporting frame for supporting a plurality of cremation urns. The frame has pairs of parallel horizontal bars and a plurality of vertical spacers interconnected for supporting the urns.

The Pangburn et al. patent, U.S. Pat. No. 3,754,805, is an urn storage assembly for the internment of cremated remains and has a plurality of tubular storage members of rectangular cross-section shaped to receive cremated remains. The Thompson patent, U.S. Pat. No. 3,529,730, is a repository for cremated remains which includes a frame structure supporting a plurality of storage tube members in a generally parallel, side-by-side and top-to-bottom relationship. Each of the storage tubes slidably receives a plurality of individual urn containers and the ends of the tubes are provided with closure means. The Pickel patent, U.S. Pat. No. 3,925,944, is directed towards niches for holding urns containing the ashes of deceased persons. A window opening in one exterior wall of a building is filled with box-shaped niches for holding the urns and each niche has an inner end panel and each niche has a decorative outer end face with a light transmitting portion attached to the outer end of the niche. The end faces contain glass inserts which are illuminated by outside light emitted through the light transmitting portion of the outer face of the wall.

The present invention is a modular storage container for cremated remains specifically shaped to fit into a prefabricated storage system or structure with each of the storage containers having a decorative panel mounted in the front thereof so that the panels are connected together to form one continuous panel.

SUMMARY OF THE INVENTION

A storage container for cremated remains has a container having a plurality of walls for receiving the cremated remains through an opening in the container. A panel insert area is formed in the container for holding a decorative panel therein. The panel insert area has a bottom flange for holding the decorative panel along the bottom edge. A decorative panel having a decorative design thereon is supported in the panel insert area for displaying the decorative design. A removable top is attached over the container opening with a plurality of fasteners and has an elongated lip formed on one side thereof extending over one side of the front panel insert area and over one edge of the decorative panel in the insert area to thereby hold the decorative panel in the insert area along the top edge. A system for storing a plurality of storage containers for cremated remains includes a plurality of horizontal frame members having a plurality of urn support brackets attached thereto with each bracket having a generally cross cross-section shape for supporting each of the urns in a predetermined position. Each urn can have a portion of an image displayed thereon so that a plurality of urn display panels can be attached to the supports to form a complete image.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
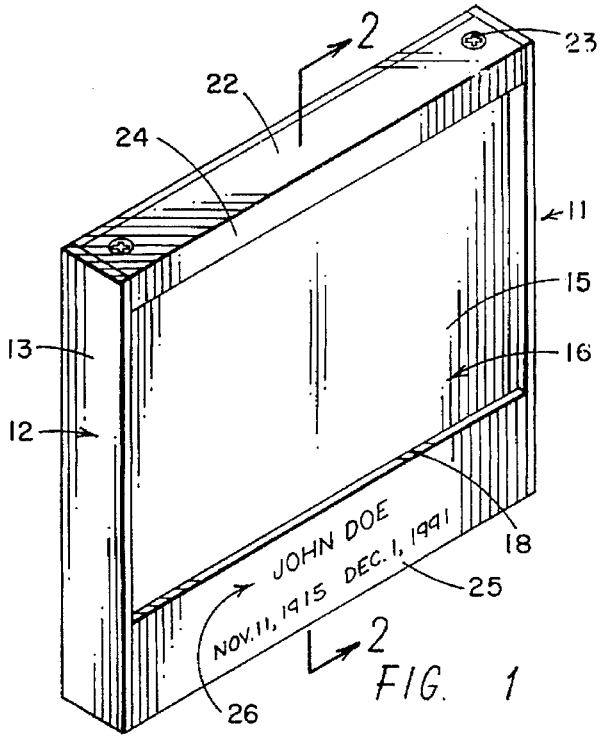
FIG. 1 is a perspective view of a container for cremated remains in accordance with the present invention.
Figure 2:
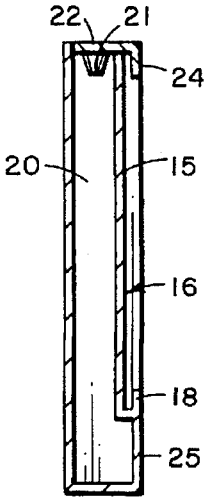
FIG. 2 is a sectional view taken on a line 2—2 of FIG. 1.
Figure 3:
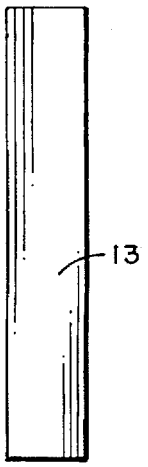
FIG. 3 is an end elevation of the container of FIG. 1.
Figure 4:
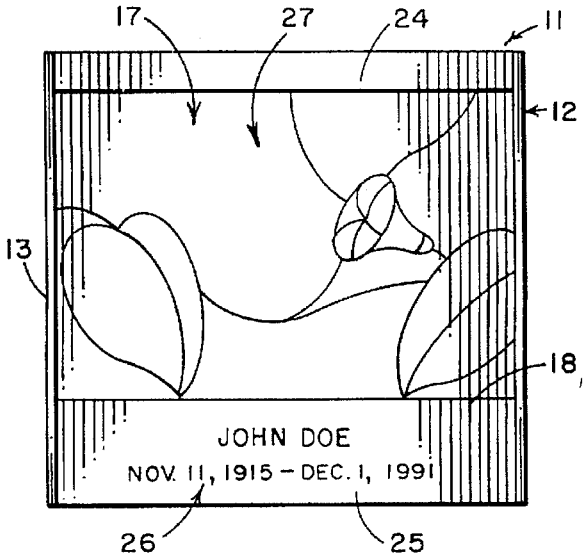
FIG. 4 is a front elevation of the container of FIG. 1 having a decorative display panel attached therein.
Figure 5:
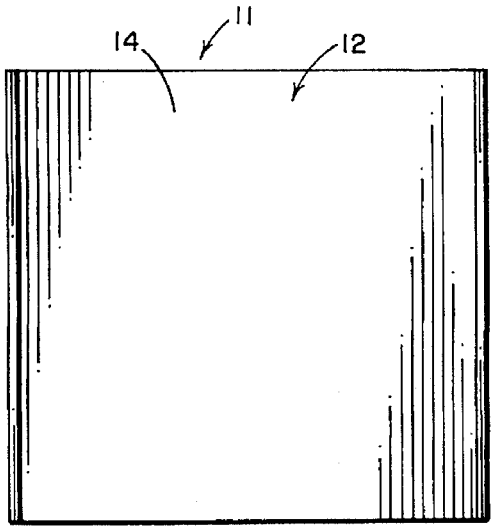
FIG. 5 is a rear elevation of the container of FIGS. 1–4.
Figure 6:
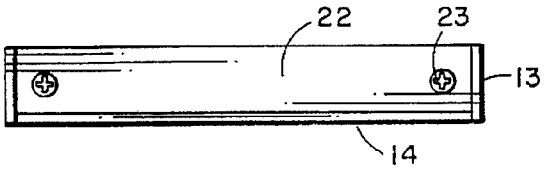
FIG. 6 is a top plan view of the container of FIG. 1.
Figure 7:
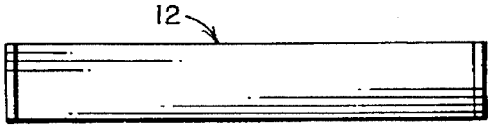
FIG. 7 is a bottom plan view of the container of FIG. 1.

Referring to the drawings and especially FIGS. 1–7, a storage container for cremated remains or urn 11 has a container body 12 having a generally rectangular shape having end sides 13, a rear side or wall 14, a recessed front wall 15 which has been recessed to form a recessed display panel insert area 16 for supporting a display panel 17, as shown in FIG. 4. The bottom of the recessed area has a raised lip or flange 18 for holding the panel 17 therein. Container 11 has an internal volume 20 which has a pair of tabs 21 protruding from either end wall 13 which tabs have been threaded so that a top 22 can be attached to seal the container 11 with threaded fasteners 23 which are threaded through openings in the top 22 into the internally threaded tabs 21 extending from each end 13 of the container 11. The top 22 has an L-shaped cross-section with an elongated lip or flange 24 positioned such that when the fasteners 23 attach the top 22 to the container 11, the elongated lip 24 extends over the panel 17 along the top edge thereof in the recessed area 16 to lock the panel 17 from the top simultaneously with sealing the opening in the top of the container. The recessed area covers only a portion of the front of the container 11 leaving a front name display area 25 on the front thereof which may have the name and dates of the deceased 26 engraved into the surface area 25.

Figure 8:
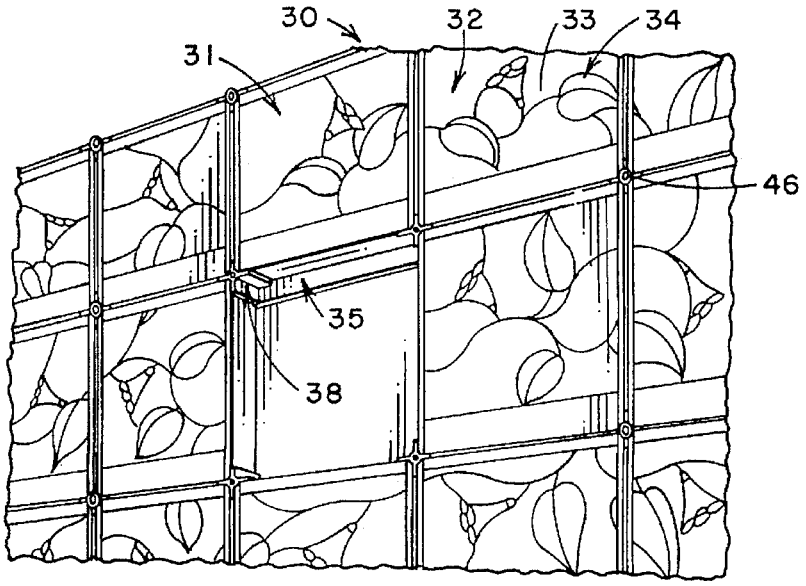
FIG. 8 is a partial perspective of an urn storage system in accordance with the present invention.

The display panel 17 may be made of glass or bronze or of any material desired, which can be transparent, mirrored, or even made of a strip of marble. The panel 17 can have a decorative image 27 formed thereon, such as by silk screening, etching or embossing, and can have part of an image which, when interconnected with other containers or urns, as shown in FIG. 8, can be used to form one complete image over a wall or wall section. The container 11 can be made of a metal, such as bronze or brass or of any material desired, and is made in a modular unit for use with the system of FIGS. 8–10 and for accepting whatever decorative display panels desired in the recess display 16. The top 22, advantageously, locks the display panels in place and the containers are such that they can be quickly positioned into the display system of FIGS. 8–10.

Figure 9:
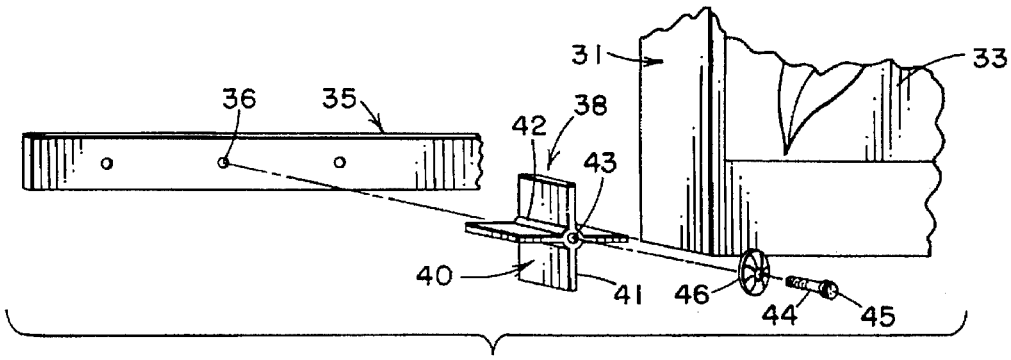
FIG. 9 is a partial exploded perspective of an attachment system for the system of FIG. 8.
Figure 10:
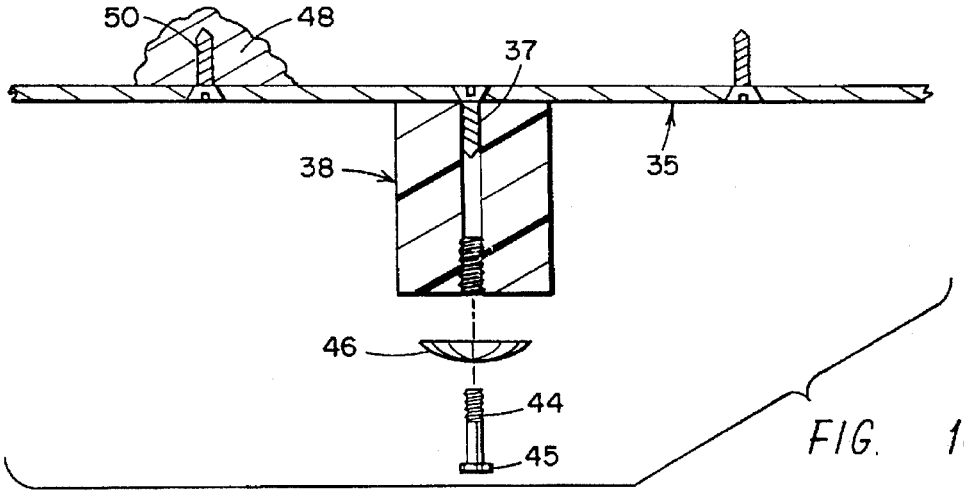
FIG. 10 is an exploded sectional view of the attachment brackets for the urn storage systems of FIGS. 8 and 9.

Turning now to FIGS. 8–10, an urn storage system 30 for internment of cremated remains is illustrated forming a wall section 31 having a plurality of urns 32 in accordance with the urns of FIGS. 1–7. Each urn has a display panel 33 having a portion of a display image 34 thereon. The urns are attached to display each of the display panels along a front wall. A series of horizontal support bars 35 may be predrilled and threaded with openings 36 and may also have bracket attaching screws 37 for attaching bracket 38. The supports are spaced to align generally with the height of each urn 31 and the series of urn supporting brackets 38 are made up of a generally cross cross-section to thereby provide four corners 40 formed from pairs of radially extending plates 41. Each plate 41 extending from a center cylinder 42 having a bore 43 extending therethrough. Each bracket 38 is attached to the vertical bars 35 with a threaded fastener 37. A threaded fastener 44 has a head 45 and extends through a rosette-shaped washer 46. The washer 46 has an opening 47 for the threaded fastener 44 to extend through. The fastener then attaches into the bore 43 and is threaded into internal threads after the horizontal bars 35 have been attached to a wall 48 with a series of threaded fasteners 50. Each urn 31 can then be mounted on corners 40 of four brackets 38 spaced on two horizontal bars 35 and have the washer 46 positioned thereover to lock the urn 31 in place supported in the four bracket 38 corners 40. Each urn is then mounted with its display panel 33 displayed in a front position and each having their name plate area 51 displayed in the front thereof. With the display panels 33 properly positioned on the urns mounted on a wall, as shown in FIG. 8, an overall decorative image can be made from the modular urns and display panels. The horizontal support bars 35 can, of course, be vertically arranged if desired.

It should be clear at this point, that an urn or storage container for cremated remains, especially human remains, has been illustrated which advantageously can be combined into an urn display and storage system as shown in FIGS. 8–10. However, the present invention should not be construed as limited to the forms shown which are to be considered illustrative rather than restrictive.

I claim:

1. A storage container for cremated remains comprising:

a container having a plurality of walls for receiving cremated remains therein through an opening in one side thereof;

a panel insert area formed in said container for holding a decorative panel therein, said panel insert area having a support flange on at least one side thereof;

a removable decorative panel having a decorative design thereon and having a plurality of edges and being positioned in said panel insert area for displaying said decorative design thereon;

a top removably attached over said container opening, said removably top having fasteners for fastening said top to said container and said removably top having a elongated lip flange formed on one side thereof and extending over one side of said front panel insert and over one edge of said decorative panel in said panel insert area to thereby hold said decorative panel to said container whereby a storage container for human remains can have a predetermined decorative front thereon.

2. A storage container for cremated remains in accordance with claim 1 in which said container panel insert area is recessed into one side of said container and has a frame flange along one side of said container display panel area to support said display panel therein.

3. A storage container for cremated remains in accordance with claim 2 in which said container has a name display area on the same container side with said panel insert area and position below said panel insert area.

4. A storage container for cremated remains in accordance with claim 3 in which said container name display area forms a front base plane area having indicia engraved thereon.

5. A storage container for cremated remains in accordance with claim 2 in which said top is an elongated L shaped top forming a lip over said panel display area to form a top frame for said display panel.

6. A storage container for cremated remains in accordance with claim 1 in which said top fasteners are threaded fasteners.

7. A storage container for cremated remains in accordance with claim 1 in which said container has a plurality of internal threaded tabs, each being attached to one said container wall inside the opening in said container for attaching said top to said container.

8. A storage container for cremated remains in accordance with claim 1 in which said container is made of metal.

9. A storage container for cremated remains in accordance with claim 8 in which said container display panel is made of glass.

10. A storage container for cremated remains in accordance with claim 9 in which said display panel has a silkscreened image thereon.

11. An urn storage system for internment of cremated remains comprising:

a plurality of horizontal frame members;

a plurality of urn containers, each container having:

a plurality of walls for receiving cremated remains therein through an opening in one side thereof and a panel insert area formed in said container for holding a decorative panel therein, said panel insert area having a flange on one side thereof and a removable decorative panel having a decorative design thereon and having a plurality of edges and being positioned in said panel insert area for displaying said decorative design thereon and a top removably attached over said container opening, said removable top having a elongated lip formed on one side thereof and extending over one side of said front panel insert and over one edge of said decorative panel in said panel insert area to thereby hold said decorative panel to said container; and a plurality of urn support brackets each bracket being attached to one said horizontal frame member and positioned to support one corner of at least two urns thereon for displaying said urns with their decorative panels facing the front of an urn storage system.

12. An urn storage system for interment of cremated remains in accordance with claim 11 in which each said urn has at least a portion of an image displayed thereon so that a plurality of urn display panels makes a complete image.

13. An urn storage system for internment of cremated remains in accordance with claim 12 in which each said urn support bracket has a generally cross cross-section and is attached to one said horizontal frame member.

14. A system for retaining and displaying a plurality of urns comprising:

a) a plurality of urns each adapted to receive cremated remains and comprising:

i) a first wall;

ii) a second wall spaced apart from said first wall to define a cremation remains receiving cavity and an urn opening in communication with said cavity;

iii) cover securable to said urn to extend across said urn opening for sealing cremation remains in said cavity;

iv) a layer of light reflective material positioned adjacent to at least said first wall such that a light reflective surface of said layer of light reflective material faces away from said first wall; and v) a layer of design forming material having portions which are at least partially translucent, said layer of design forming material forming at least a portion of a graphic design, said layer of design forming material securable to said urn such that said layer of light reflective material is positioned between said layer of design forming material and said wall adjacent to which said light reflective material is positioned;

(b) means for securing and positioning said urns generally in adjacent alignment such that said portions of said graphic design are aligned to display said graphic design.

* * * * *